US007694781B2

(12) United States Patent
Sorsa et al.

(10) Patent No.: US 7,694,781 B2
(45) Date of Patent: Apr. 13, 2010

(54) ELEVATOR CALL ALLOCATION AND ROUTING SYSTEM

(75) Inventors: Janne Sorsa, Helsinki (FI); Marja-Liisa Siikonen, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/340,478

(22) Filed: Dec. 19, 2008

(65) Prior Publication Data

US 2009/0159374 A1 Jun. 25, 2009

Related U.S. Application Data

(63) Continuation of application No. PCT/FI2007/000149, filed on May 31, 2007.

(30) Foreign Application Priority Data

Jun. 19, 2006 (FI) ..... 20060603

(51) Int. Cl.
*B66B 1/16* (2006.01)

(52) U.S. Cl. ..... 187/382; 187/902

(58) Field of Classification Search ..... 187/280–289, 187/391–393, 902, 247; 706/910
See application file for complete search history.

(56) References Cited

U.S. PATENT DOCUMENTS

| | | | | |
|---|---|---|---|---|
| 4,993,518 | A | 2/1991 | van Straaten et al. | |
| 5,304,752 | A | 4/1994 | Hayashi | |
| 5,616,896 | A * | 4/1997 | Kontturi et al. | 187/384 |
| 5,689,094 | A * | 11/1997 | Friedli et al. | 187/384 |
| 6,237,721 | B1 | 5/2001 | Siikonen | |
| 6,293,368 | B1 | 9/2001 | Ylinen et al. | |
| 6,945,365 | B2 * | 9/2005 | Matela | 187/382 |
| 7,108,106 | B2 * | 9/2006 | Kostka | 187/391 |
| 2001/0002636 | A1 | 6/2001 | Siikonen | |
| 2003/0000776 | A1 | 1/2003 | Kostka | |
| 2003/0085079 | A1 | 5/2003 | Koehler et al. | |

FOREIGN PATENT DOCUMENTS

| | | | |
|---|---|---|---|
| WO | WO-98/32683 | A1 | 7/1998 |
| WO | WO-99/33741 | A2 | 7/1999 |
| WO | WO-01/72621 | A1 | 10/2001 |

* cited by examiner

*Primary Examiner*—Jonathan Salata
(74) *Attorney, Agent, or Firm*—Birch, Stewart, Kolasch & Birch, LLP

(57) ABSTRACT

A method for allocating destination calls in an elevator system, the system including at least one multi-deck elevator, where the passenger gives his/her destination floor by means of a destination call device at the beginning of the journey route, thereby defining the staffing point and final point of the passenger's journey route in the elevator system. The method includes the steps of generating possible route alternatives from the staffing point to the final point of the journey route, determining a cost function containing at least one travel time term, determining the value of the travel time term corresponding to each route alternative in the cost function, calculating the total cost of each route alternative by using the cost function, allocating for the passenger the route alternative that gives the minimum total cost, and guiding the passenger to a waiting lobby and/or elevator consistent with the route alternative allocated.

27 Claims, 3 Drawing Sheets

ELEVATOR CALL ALLOCATION AND ROUTING SYSTEM

Figure 1:
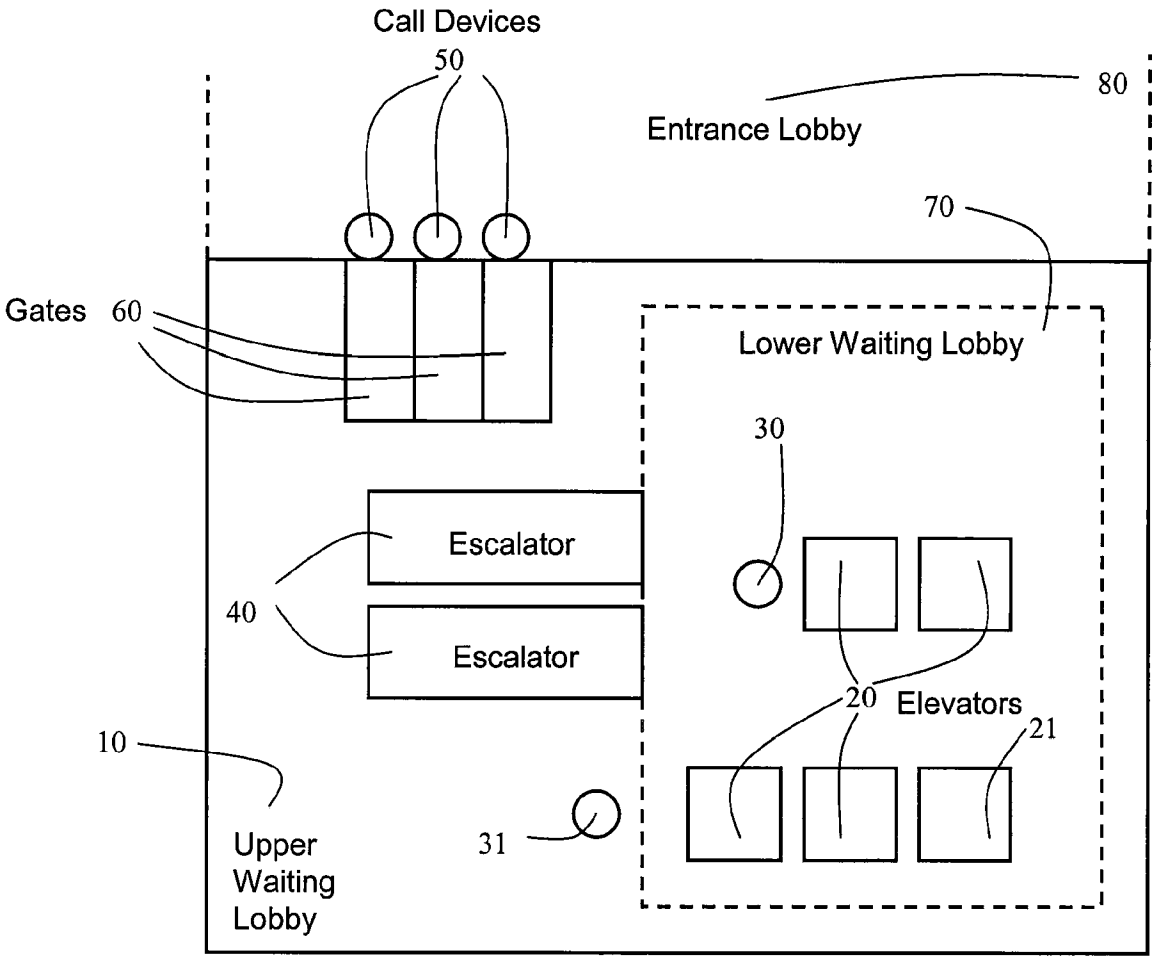

This application is a Continuation of copending PCT International Application No. PCT/FI2007/000149 filed on May 31, 2007, which designated the United States, and on which priority is claimed under 35 U.S.C. §120. This application also claims priority under 35 U.S.C. §119(a) on Patent Application No(s). 20060603 filed in Finland on Jun. 19, 2006. The entire contents of each of the above documents is hereby incorporated by reference.

The present invention relates to passenger transport in buildings. In particular, the present invention relates to a method and an elevator system for allocating destination calls in buildings.

Multi-floor buildings are typically provided with numerous elevators, escalators, automatic doors, access control gates and other corresponding means for trans-porting and guiding passengers from one place to another in the buildings. When traveling in a building, the passenger has to issue elevator calls in order to reach his/her destination on the target floor. The group control of the elevator system allocates an elevator for use by the passenger according to the situation prevailing in the elevator system and on the basis of given optimization criteria. In a conventional elevator system, call entry is arranged by providing each floor of the building with up/down buttons by means of which the passenger indicates the desired traveling direction and further, after an elevator has arrived at the floor where the passenger is located, the passenger indicates the desired destination floor by means of floor selection buttons provided in the elevator car. However, the above-described call entry method is impractical and inefficient in tall buildings, which is why call entry in the elevator systems in such buildings is increasingly implemented using a so-called destination call system, wherein each passenger gives his/her individual destination data already at the starting floor, e.g. in the elevator lobby before boarding an elevator car. A destination call is input via a specific destination call terminal using either buttons and/or electrically readable identification devices. As the starting and final points of the route to be traveled by each passenger are identified by the destination call and are therefore available to the group control, the group control system is able to determine the passenger's route accurately and optimally as compared to the traditional call entry system. It is also easy to combine a destination call system with an access control system wherein passengers only have access to a limited part of the building. Access control is taken care of in connection with the entry of a destination call by identifying the passenger e.g. on the basis of an electrically readable ID card or a PIN code to be input manually. To improve the efficiency of elevator systems in tall buildings, multi-car elevators may be used. In multi-car elevators, two or more elevator cars are arranged in the same frame structure, which moves in the elevator shaft under control of a drive machine, so that the elevator serves several floors simultaneously when it stops. To ensure efficient operation of multi-car elevators, the entrance lobby of the building is often divided into several waiting lobbies interconnected e.g. by escalators.

Among its many different functions, the basic function of the group control of an elevator system is allocation of the elevator calls entered by passengers. The aim of allocation is to estimate different route alternatives for the passengers and to allocate the calls to be served by the elevators in such a way that one of the indicators describing the elevator system or a combination of such indicators is optimized. Traditionally, the most commonly used indicators relate to passenger service times, but it is also possible to use optimization criteria relating to energy or some other corresponding property of the elevator system. To compare different route alternatives, a so-called cost function is generally used, minimization of whose value (total cost) for different route alternatives indicates optimal allocation. Allocation can be so implemented that in different traffic situations the cost function best suited for the particular situation is applied. The purpose of this is to allow the system to adapt to the prevailing traffic situation, e.g. an up-peak traffic situation in the building. To identify the prevailing traffic situation, a prior-art control system described e.g. in Finnish patent specification FI113531B uses a traffic predictor which monitors the operation of the elevator system and creates statistics on the passenger flows observed in the elevator system at different times of the day and on different days of the week. The items monitored in the traffic predictor typically include elevator calls entered by passengers, car loads of elevators and different light cells and other corresponding motion detectors.

When multi-car elevators are used, the destination call devices can be disposed either in waiting lobbies in the immediate vicinity of the elevators or in centralized manner e.g. in the entrance lobby of the building, from where passengers are typically guided via escalators into the waiting lobby according to the route allocated for the passenger and further to the elevator to serve him/her. An inconvenience in the first-mentioned arrangement, in which the destination call devices are disposed in each waiting lobby in the vicinity of the elevators, is that the passenger him/herself has to choose the waiting lobby according to which floor he/she is heading for, for example the lower lobby for passengers traveling to even floors and the upper lobby for passengers going to odd floors. This naturally is a source of uncertainty for the passenger, causing unnecessary difficulties regarding his/her traveling. Moreover, the arrangement in question provides a limited number of allocation alternatives for the passenger, causing underutilization of the capacity of the elevator system. In the latter arrangement, in which the destination call devices are disposed in a centralized manner in the entrance lobby, a problem is the rather long and often also varying time it takes the passenger to get from the destination call device to the elevator serving the call, which causes difficulties in the allocation and timing of elevators for picking up the passengers from the waiting lobby. Similarly, the time required for the passenger to move from the elevator to the final point of the journey (destination floor) or from one elevator to another on the transfer floor may be significant, especially if, to get from the elevator to the destination floor or to transfer from one elevator to another, the passenger has to move from one waiting lobby to another in order to reach the destination. In prior-art solutions, passenger travel times are assumed to be constant or travel times are not taken into account at all. Likewise, changes in travel times according to the situation prevailing in the elevator system, such as congestion, are not at taken into account at all in prior-art methods. It is obvious that fixedly set compromise values like this are not optimal in the changing conditions of an elevator system. The result is inaccurate allocation, which means that either elevator waiting times are too long or passengers are unable to catch the elevator serving them, leading to congested situations, reduced traveling comfort and reduced transport capacity of the elevator system. In addition, prior-art solutions involve limitations regarding the layout of the elevator system and associated transport arrangements in the building because the call input devices have to be placed as close to the elevators as possible. Prior-art solutions are also ill adaptable to emergency situations, such as e.g. equipment break-downs or evacuation situations, in which the routing of passengers in the elevator system has to be implemented in ways other than normal.

The object of the present invention is to overcome some of the above-described drawbacks encountered in prior-art solutions. A further object of the invention is to accomplish one or more the following objectives:

- automatic monitoring and correction of travel time forecasts on the basis of statistical data collected about an elevator system,
- reduction of congestion in waiting lobbies and improvement of traveling comfort in an elevator system,
- easy integration of access control,
- more accurate travel time forecasts in exceptional situations occurring in the elevator system.

The method of the invention is characterized by what is disclosed in the characterizing part of claim 1. The elevator system of the invention is characterized by what is disclosed in the characterizing part of claim 15. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

Listed below are detailed definitions of the meanings of certain terms used in this context:

- multi-deck elevator: This term refers to an elevator having two or more elevator cars mounted in a common frame structure which is moved in an elevator shaft by an elevator drive machine. A multi-deck elevator serves two or more waiting lobbies simultaneously when stopping at floors.
- waiting lobby: This term refers to a lobby or floor where passengers wait for a serving elevator in order to board the elevator car, or correspondingly to a floor or lobby for exit from an elevator car, or to a transfer floor lobby via which passengers can transfer from one elevator to another in order to reach their destinations.
- entrance lobby: This term refers to a lobby or floor via which passengers enter and/or leave the building. Typically the entrance lobby is the street-level floor of the building.
- state of the elevator system: Defines the traffic condition prevailing in the elevator system as well as exceptional situations possibly prevailing in the elevator system, such as e.g. equipment breakdowns or maintenance work or evacuation situations and other corresponding situations.
- traffic condition: Defines the traffic type and traffic intensities prevailing in the elevator system both locally and generally in the building.
- traffic type: Indicates the direction of passenger flows generally prevailing in the elevator system, e.g. up-peak, down-peak, two-way traffic, mixed traffic.
- traffic intensity: Indicates the intensity of traffic prevailing in the elevator system in general or on different floors, e.g. light traffic, normal traffic, heavy traffic.
- transfer route: This term refers to the sub-trips traveled by the passenger to get from the destination call device to the allocated elevator, from the elevator to the destination floor or from one elevator to another on a transfer floor.
- travel time: This term refers to the time it takes for a passenger to travel through a given transfer route.

In the method of the invention, destination calls are allocated in an elevator system which comprises at least one multi-deck elevator and the required waiting lobbies. The passenger indicates his/her destination floor via a destination call device at the beginning of the journey, defining the starting point and final point of the journey route. According to the invention, route alternatives are formed for the allocation of the passenger's destination call in the elevator system. The method comprises determining a cost function containing at least one travel time term, the value of which is determined for each route alternative. Using the cost function, the total cost of each route alternative is solved, the one of which route alternatives that gives the minimum cost is allocated for the passenger, and the passenger is guided to a waiting lobby and/or elevator consistent with the route alternative in question.

In the elevator system of the invention, destination calls are allocated. The elevator system comprises a group controller, guiding means, at least one multi-deck elevator and at least one destination call device for the input of destination floor at the beginning of a journey route, defining the starting point and final point of the passenger's journey route in the elevator system. According to the invention, the system is adapted to form possible route alternatives from the starting point of the passenger's journey route to the final point, to determine a cost function containing at least one travel time term and to determine the value of the travel time term corresponding to each route alternative in the cost function. The system is further adapted to calculate the total cost of each route alternative by using the cost function, to allocate for the passenger the route alternative that gives the minimum total cost and to guide the passenger to a waiting lobby and/or elevator consistent with the allocated route alternative.

In an embodiment of the invention, at least one destination call device is arranged in the entrance lobby of the building so that access is provided from the entrance lobby to the waiting lobbies serving at least one multi-deck elevator.

In an embodiment of the invention, the value of at least one travel time term is determined on the basis of a criterion dependent on the state of the elevator system.

In an embodiment of the invention, a transfer route model is generated, wherein a travel time forecast for one or more transfer routes in the elevator system is determined on the basis of a criterion dependent on the state of the elevator system.

In an embodiment of the invention, the criterion dependent on the state of the elevator system used consists of one or more criteria defining the state of the elevator system or a combination of them, said criteria including: traffic type prevailing in the elevator system, general traffic intensity prevailing in the elevator system, waiting lobby-specific traffic intensity, emergency situation prevailing in the elevator system.

In an embodiment of the invention, one or more transfer routes for a route alternative are formed from traveling actions which are carried out using one or more transport arrangements, said transport arrangements including: escalators, stairs, waiting lobby, access control gate, automatic door, corridor, passenger conveyor.

In another embodiment of the invention, the proportion of passengers having missed their elevator in the total number of passengers on the transfer route is monitored for each transfer route to correct the travel time forecasts for the transfer route.

In another embodiment of the invention, the travel time forecast for the route is extended when the proportion of belated passengers exceeds a given first threshold value.

In another embodiment of the invention, the travel time forecast for the transfer route is reduced when the proportion of belated passengers deceeds a given second threshold value.

In another embodiment of the invention, belated passengers are identified on the basis of re-entered destination calls.

In another embodiment of the invention, destination calls entered via secondary destination call devices are used to identify belated passengers.

In another embodiment of the invention, the transfer route selected for the route alternative is the transfer route having the shortest travel time forecast.

In another embodiment of the invention, possible transfer routes for a route alternative are excluded on the basis of an emergency situation prevailing in the elevator system.

In another embodiment of the invention, routes in which, on the basis of the value of the travel time term, the passenger would miss the serving elevator are excluded from among the route alternatives.

The present invention has several advantages as compared to prior-art solutions. In the allocation of destination calls, even long passenger travel times for different transfer routes can be taken into more detailed consideration than before. By considering the state prevailing in the elevator system at each instant, more accurate travel time forecasts can be produced. Also, different transfer routes comprising e.g. stairs, escalators, automatic doors, access control gates, corridors and other corresponding transport arrangements can be taken into account better than before in call allocation. Congestion in waiting lobbies is reduced and traveling comfort is improved, and passengers do not need to spend unnecessary time in waiting lobbies waiting for the elevators serving them, which also allows the transport capacity of the elevator system to be optimized. Further, the layout of the elevator system and associated traffic arrangements can be designed more freely because the destination call devices need not be placed in the immediate vicinity of the elevators but even long transfer routes can be allowed in the layout. Destination call devices can be centralized in entrance lobbies, in which case the passenger need not personally choose the waiting lobbies to reach the destination, because the elevator system will guide the passenger to the correct waiting lobby if necessary. Especially when multi-deck elevators are used, traveling is made easier because the passenger need not personally select the right waiting lobby (upper lobby/lower lobby) on the journey route. Moreover, access control in the building is facilitated because the access control systems can be disposed in the entrance lobby of the building, thus obviating the need to provide a plurality of waiting lobby-specific access control systems. The invention also allows more effective allocation of destination calls, because, depending on the elevator system, several alternative route alternatives are available for the allocation of a passenger's destination call. Especially the allocation of the elevator cars of multi-deck elevators for the passenger becomes easier because allocation is not bound to the conventional upper lobby/lower lobby division. Routing the passengers in exceptional situations occurring in the elevator system is also easy and does not cause any extra error in travel time forecasts. Travel time forecasts can be corrected on the basis of information collected about the elevator system, so that the travel time forecasts are automatically made more accurate and e.g. changes in the passenger type (young/old people etc.) of the building are taken into account.

LIST OF FIGURES

Figure 2:
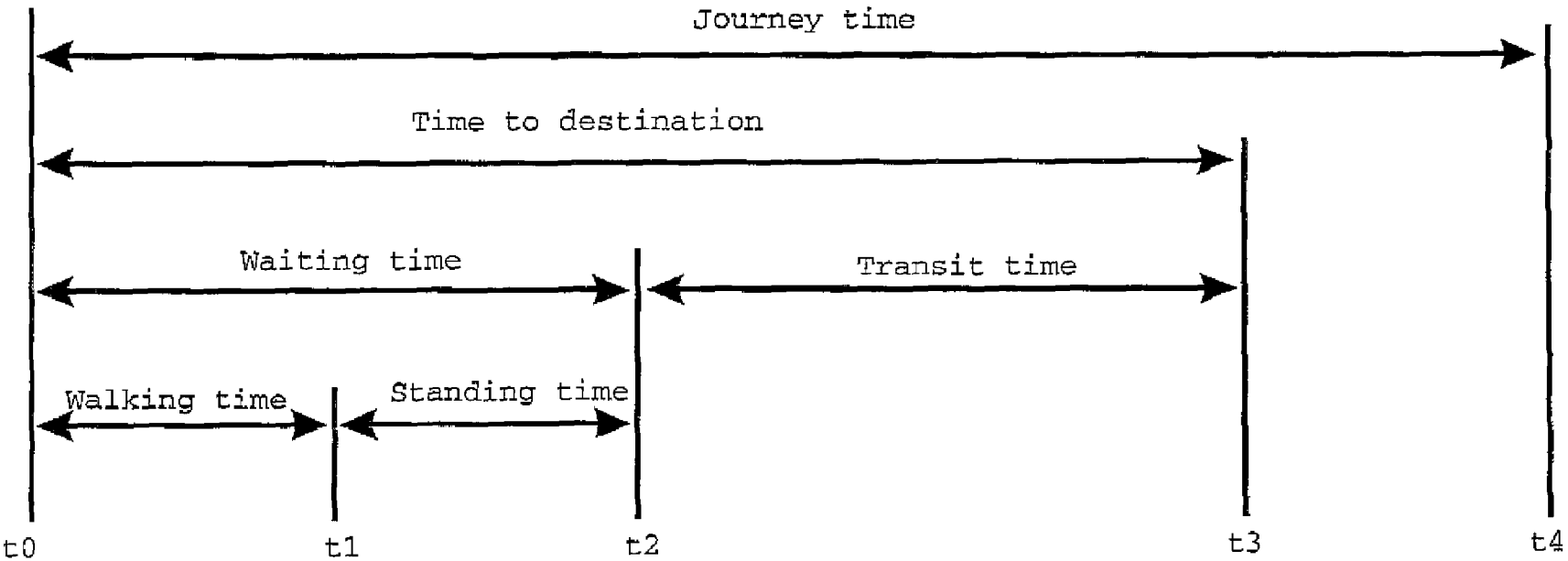
Figure 3:
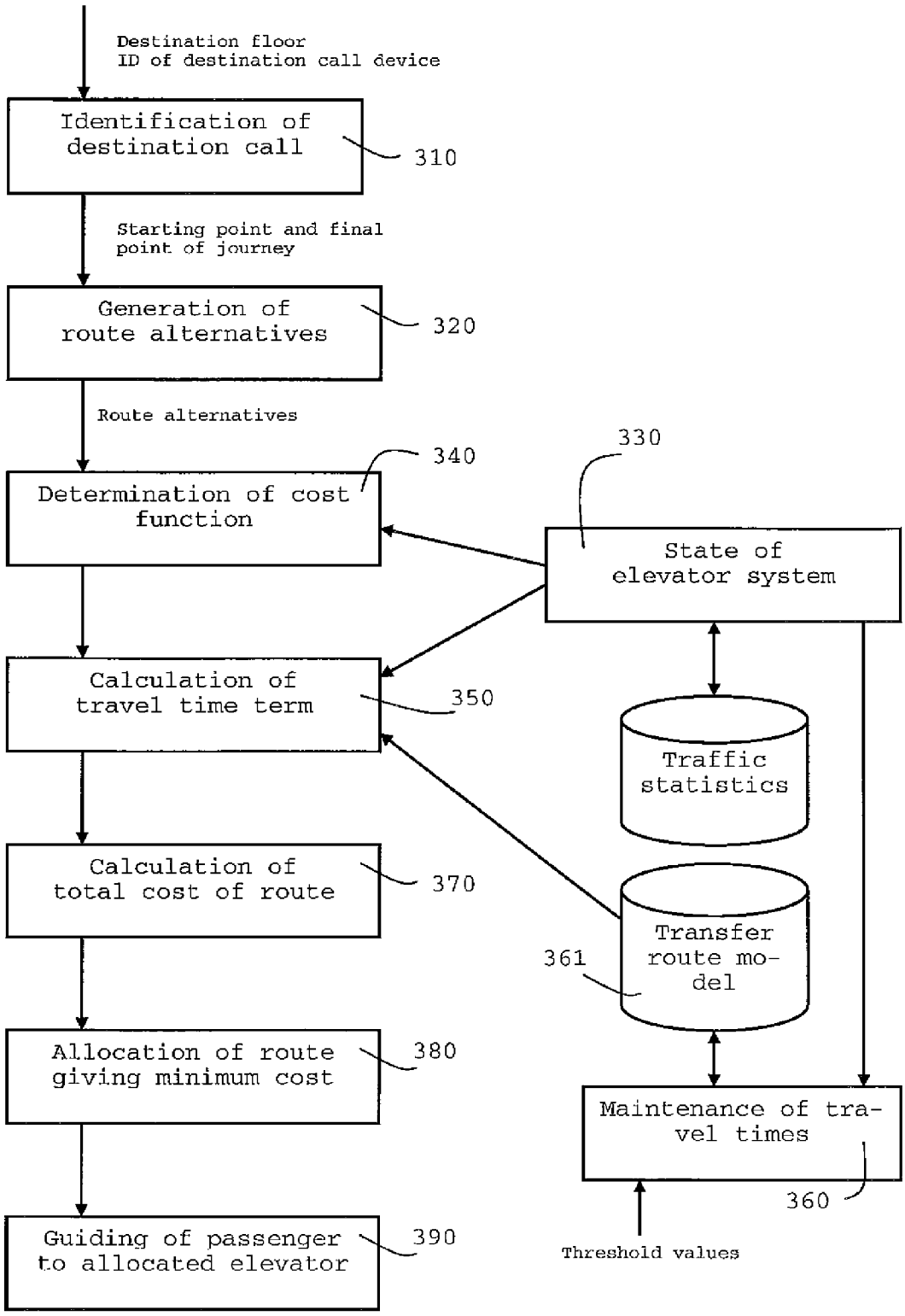

In the following, the invention will be described by referring to the attached drawings, wherein FIG. 1 presents an example of the layout of transport arrangements in an elevator system, FIG. 2 represents the temporal progress of traveling actions, and FIG. 3 presents a block diagram of a system according to the invention.

DETAILED DESCRIPTION OF THE INVENTION

FIG. 1 presents an example of a traffic arrangement in the entrance lobby of a building, which arrangement comprises the entrance lobby 80, waiting lobbies 10 (upper lobby) and 70 (lower lobby). Passengers are served by four double-deck elevators 20 and one single-deck elevator 21 from the waiting lobbies 70 and 10. The elevator waiting lobbies 10 and 70 are interconnected by escalators 40, which can be used by the passenger to move from the lower waiting lobby to the upper waiting lobby and vice versa. Provided in the entrance lobby 80 of the building are destination call devices 50 for the entry of destination calls to the elevator system from the entrance lobby. Integrated with the destination call devices 50 are access control gates 60, by means of which the access of passengers to other floors of the building can be limited. The system further comprises secondary destination call devices disposed in the vicinity of the elevators so that secondary destination call device 31 is placed in the lower lobby 10 and secondary destination call device 30 in the upper lobby. The elevator group is controlled by means of a group controller (not shown in FIG. 1) which communicates with the destination call devices 50,31,30 and the elevator control systems (not shown in FIG. 1) of the elevators 20,21. The group controller is e.g. a computer provided with a processor, memory and the required interfaces and software.

Having arrived in the entrance lobby 80, the passenger enters a destination call to the desired floor by means of a destination call device 50 either by using buttons or an electrically readable identification means. If access to the destination floor is subject to verification of access rights, then the passenger must additionally give a personal identification code in connection with the destination call in order to get through the access control gate 50 and to gain access to the desired floor. The identification may be based on a PIN code manually keyed in or on automatically readable electric identification means. The verification of access rights may be performed either in an independently working access control system or alternatively in the group controller of the elevator system.

The group controller receives the passenger's destination call, allocates an optimal route for him/her and guides the passenger to the elevator serving him/her. If the waiting lobby indicated to the passenger is the lower lobby 10, then he/she can move directly in the lower lobby from the access control gate 60 to the serving elevator. Correspondingly, if the waiting lobby indicated to the passenger is the upper lobby 70, then he/she will have to move from the access control gate 40 by escalator 40 to the upper lobby and further to the serving elevator. Having arrived at the elevator (elevator door) assigned for him/her, the passenger either boards the elevator (elevator car) immediately or remains waiting for the arrival of the elevator if the serving elevator has not yet reached the waiting lobby in question. If the passenger comes too late to catch the elevator allocated for him/her, then he/she can re-enter his/her destination call by using the secondary destination call device 30 or 31 provided in the waiting lobby. The passenger can also use the secondary destination call devices to change his/her destination floor. Having boarded the elevator car of the elevator serving him/her and traveled the elevator journey allocated to him/her, the passenger arrives in a waiting lobby which is either the passenger's desired destination floor or a waiting lobby connected to the final destination floor e.g. by an escalator.

FIG. 2 presents an example of the temporal progress of traveling actions in an elevator system:

- instant t0: at instant t0 the passenger enters a destination call on the starting floor,
- walking time t1–t0: the passenger moves from the call input device into the waiting lobby and further to the immediate vicinity of the elevator serving him/her,
- waiting time t2–t1: the passenger waits for the serving elevator to arrive,
- transit time t3–t2: after the elevator doors are opened, the passenger boards the elevator car, which takes him/her from starting floor to the destination floor,
- walking time t4–t3: after the elevator doors are opened, the passenger exits from the elevator car to the destination floor,
- journey time t4–t0: total time spent on the journey.

FIG. 3 presents a functional block diagram of the system according to FIG. 1, which implements the method of the invention.

In block 310, a destination call (the number of a destination floor) entered by a passenger is received along with the identifier (ID) of the destination call device corresponding to the call. On the basis of the destination call data and the said identifier of the destination call device, the group controller is able to determine both the starting point and final point of the passenger's journey route. The receipt of calls for an elevator may also include identification of special calls, such as calls by handicapped persons. The destination call may also be based on identification of the passenger's personal identification code, in which case the elevator system contains stored information about passengers' journey profiles including the passenger's destination floor data, which can be read on the basis of the aforesaid identification code.

In block 320, route alternatives between the starting point and final point of the passenger's journey route are generated using e.g. genetic methods. (As for genetic methods, reference is here made to Finnish patent specification FI1073779B). Each route alternative defines the waiting lobbies comprised in the route as well as the elevator serving it. For multi-deck elevators, there are two or more waiting lobbies, each one of which constitutes a separate route alternative.

Block 330 contains functions determining the state of the elevator system. To enable the traffic condition prevailing in the elevator system to be predicted, traffic statistics on passenger flows in the elevator system are collected in this block. Based on the traffic statistics, a forecast is generated regarding the traffic type prevailing in the elevator system at each particular point of time, the general traffic intensity as well as the traffic intensity in each lobby. The traffic statistics are produced by monitoring e.g. the elevator calls entered by passengers, the car loads of the elevators and/or motion detectors, such as e.g. car light cells. In a pure destination call system, the lobby-specific traffic intensities can be calculated directly on the basis of the calls entered by passengers. To identify exceptional situations in the elevator system, the block comprises monitoring of signals internal and/or signals external to the elevator system which are indicative of exceptional situations in the elevator system.

In block 340, a cost function is determined which contains one or more travel time terms depending on the state of the elevator system. The cost function to be used depends on the traffic situation (traffic type and traffic intensity) prevailing in the elevator system in such manner that, for allocation of the passenger's destination call, the cost function optimizes the elevator system parameter or parameters best suited to the traffic situation at hand. Each travel time term in the cost function takes into account the travel times used by the passenger on the transfer route of the journey.

In block 350, the values of the travel time terms included in the cost function are determined taking into account the state of the elevator system. The values of the travel time terms are obtained from a transfer route model 361, in which a predicted travel time for each transfer route is stored on the basis of a criterion dependent on the state of the elevator system. As storage criteria, it is possible to use e.g. the traffic type prevailing in the elevator system, general traffic intensity, lobby-specific traffic intensity, an emergency situation encountered in the elevator system, or a combination of these criteria. One or more of the travel time forecasts may be defined as permanent forecasts, or the travel time forecast may be determined using e.g. heuristic calculation methods. If there are several possible transfer routes, for example when the passenger could move from the destination call device into the waiting lobby using alternative escalators, then the transfer route giving the shortest travel time forecast and the corresponding travel time forecast are selected. If there is an exceptional situation prevailing in the elevator system, e.g. if one of the escalators connecting the waiting lobbies is out of use, then transfer routes not suited for the exceptional situation in question are excluded and the fastest one of the remaining transfer routes is selected.

In block 360, statistics on passengers having missed the allocated elevators on different transfer routes are maintained, taking into account the state of the elevator system at the relevant times. To determine the proportion of belated passengers, it is possible to monitor elevator calls entered by passengers, car loads and/or motion detectors, such as car light cells. Belated passengers can advantageously be identified on the basis of destination calls re-entered via secondary destination call devices. If the proportion of belated passengers on a given transfer route exceeds a given threshold value, then the travel time forecast in question is extended by a time increment. The time increment may be a system-internal setting parameter and/or a calculated value, e.g. a time increment based on divergence of travel times. Similarly, when the proportion of belated passengers is below a given second threshold value, the travel time forecast in question is shortened.

In block 370, the total cost of each route alternative is calculated. The calculation of the total cost is performed using the travel time forecasts calculated in block 350 and a model of the elevator group (not shown in FIG. 3). The model of the elevator group defines the velocities of the elevators, elevator car sizes, operating times of the elevator doors, locations of the destination call devices and elevators in the building as well as other elevator-specific rules of behavior and parameters required in the calculation of the total cost. Those route alternatives in which, considering the travel time forecasts, the passenger is likely to miss the elevator serving the route are excluded in the calculation of the total cost.

In block 380, the total costs of the route alternatives are compared to each other and the route alternative giving the minimum cost is allocated to the passenger. Based on the allocated route alternative, the group controller performs a number of actions to implement the route, such as e.g. timing the required elevator calls to bring the passenger from the waiting lobby to the destination floor. In the case of multi-deck elevators, it is not necessary to settle on the elevator car of the elevator immediately when a destination call is being allocated; instead, it suffices to have the passenger's waiting lobby and the elevator serving him/her fixed immediately in connection with the destination call whereas the elevator car to serve the passenger is only settled on at a later stage of the journey, e.g. just before arrival of the elevator at the passenger's waiting lobby.

In block 390, the passenger is informed, using guiding devices comprised in the elevator system, as to the waiting lobby and/or elevator according to the route alternative allocated for him/her. The guiding devices may consist of e.g. display and/or sound reproduction devices arranged in conjunction with the destination call devices and/or elevator doors. Via the guiding device provided in conjunction with the destination call device, the passenger is informed as to the waiting lobby and/or elevator he/she should move into. Via the display means provided in conjunction with the elevator door, the passenger can be shown those destination floors to which destination calls have been allocated for the elevator in question. Based on this guidance information, the passenger will find the elevator serving him/her so he/she can reach the destination floor.

It is obvious to a person skilled in the art that different embodiments of the invention are not exclusively limited to the examples described above, but that they may be varied within the scope of the claims presented below.

The invention claimed is:

1. A method for allocating destination calls in an elevator system, said elevator system including at least one multi-deck elevator, and a destination call device with which a passenger gives his/her destination floor at the beginning of the journey route, thereby defining the starting point and final point of the passenger's journey route in the elevator system, the method comprising:

generating possible route alternatives from the starting point to the final point of the passenger's journey route;

determining a cost function for the route alternatives, said cost function containing at least one travel time term;

determining the value of the at least one travel time term corresponding to each route alternative in the cost function;

calculating the total cost of each route alternative by using the cost function;

allocating, for the passenger, the route alternative having the lowest calculated total cost;

guiding the passenger to a waiting lobby and/or elevator according to the route alternative allocated; and generating a transfer route model in which one or more travel time forecasts for one or more transfer routes in the elevator system are determined on the basis of a criterion dependent on a state of the elevator system.

2. A method according to claim 1, further comprising providing access from an entrance lobby of a building containing said elevator system to waiting lobbies serving at the least one multi-deck elevator by disposing at least one destination call device in the entrance lobby.

3. A method according to claim 1, determining the value of the at least one travel time term including determining the value of said travel time term based on a criterion dependent on a state of the elevator system.

4. A method according to claim 3, wherein said criterion dependent on a state of the elevator system includes one or more criteria defining the state of the elevator system or a combination of them, said criteria including: traffic type prevailing in the elevator system, general traffic intensity prevailing in the elevator system, waiting lobby-specific traffic intensity, exceptional situation prevailing in the elevator system.

5. A method according to claim 1, further comprising forming one or more transfer routes for a route alternative from traveling actions carried out using one or more transport arrangements, said transport arrangements including: escalators, stairs, waiting lobby, access control gate, automatic door, corridor, passenger conveyor.

6. A method according to claim 1, further comprising monitoring a proportion of belated passengers, who are passengers that missed the elevator, in the total number of passengers on each transfer route; and correcting the travel time forecasts for the transfer route based on said monitoring.

7. A method according to claim 6, wherein correcting includes extending the travel time forecast for the route is when the proportion of belated passengers exceeds a given first threshold value.

8. A method according to claim 6, wherein correcting includes shortening the travel time forecast for the transfer route when the proportion of belated passengers is below a given second threshold value.

9. A method according to claim 6, wherein belated passengers are identified on the basis of re-entered destination calls.

10. A method according to claim 9, where destination calls re-entered via secondary destination call devices are used to identify belated passengers.

11. A method according to claim 1, further comprising selecting from said one or more transfer routes a transfer route having the shortest travel time forecast as the transfer route for the route alternative.

12. A method according to claim 1, wherein possible transfer routes for a route alternative are excluded on the basis of an exceptional situation prevailing in the elevator system.

13. A method according to claim 1, wherein routes in which, considering the value of the travel time term, the passenger is likely to miss the serving elevator are excluded from among the route alternatives.

14. An elevator system for allocating destination calls, said elevator system comprising:

a group controller, a guiding portion that guides the passenger in the elevator system, at least one multi-deck elevator, at least one destination call device that accepts input of a destination floor at the beginning of a journey route, said input defining the starting point and final point of a passenger's journey route in the elevator system, an alternative route determination unit that forms possible route alternatives from the starting point to the final point of the passenger's journey route;

a cost function generator that generates a cost function for the route alternatives, said function containing at least one travel time term;

a travel time term value determination unit that determines the value of the at least one travel time term corresponding to each route alternative in the cost function;

a cost calculator that calculates the total cost of each route alternative by using the generated cost function;

a route allocator that allocates, for the passenger, the route alternative with the smallest calculated total cost;

a guidance portion that guides the passenger to a waiting lobby and/or elevator according to the allocated route alternative; and a transfer route model unit that determines a travel time forecast for one or more transfer routes in the elevator system based on a criterion dependent on the state of the elevator system.

15. An elevator system according to claim 14, wherein the at least one destination call device is arranged in an entrance lobby of a building so as to provide access from the entrance lobby to waiting lobbies serving the at least one multi-deck elevator.

16. An elevator system according to claim 14, wherein the travel time term value determination unit determines the value of the at least one travel time term based on a criterion dependent on the state of the elevator system.

17. An elevator system according to claim 16, wherein the criterion dependent on the state of the elevator system includes of one or more criteria defining the state of the elevator system or a combination of them, said criteria including: traffic type prevailing in the elevator system, general traffic intensity prevailing in the elevator system, waiting lobby-specific traffic intensity, exceptional situation prevailing in the elevator system.

18. An elevator system according to claim 14, wherein the route determination unit determines one or more transfer routes for a route alternative based on traveling actions for whose accomplishment there are available one or more transport arrangements, said transport arrangements including: escalators, stairs, waiting lobby, access control gate, automatic door, corridor, passenger conveyor.

19. An elevator system according to claim 14, wherein the elevator system further comprises a monitoring portion that monitors, on each transfer route, the proportion of passengers having missed the elevator in the total number of passengers on the transfer route; and a travel time forecast corrector that corrects the travel time forecasts for the transfer route based on monitoring results.

20. An elevator system according to claim 19, wherein the forecast corrector extends the travel time forecast for the route when the proportion of belated passengers exceeds a given first threshold value.

21. An elevator system according to claim 19, wherein the forecast corrector shortens the travel time forecast for the route when the proportion of belated passengers is below a given second threshold value.

22. An elevator system according to claim 19, wherein the monitoring portion identifies belated passengers on the basis of re-entered destination calls.

23. An elevator system according to claim 22, wherein the monitoring portion uses destination calls entered via secondary destination call devices to identify belated passengers.

24. An elevator system according to claim 14, where the route allocator selects, as the transfer route for the route alternative, the transfer route having the shortest travel time forecast.

25. An elevator system according to claim 14, wherein the route allocator excludes possible transfer routes for a route alternative on the basis of an exceptional situation prevailing in the elevator system.

26. An elevator system according to claim 14, wherein the route allocator excludes from among the route alternatives those routes in which, considering the value of the travel time term, the passenger is likely to miss the serving elevator.

27. A computer readable medium having embodied thereon a program that, when executed in or with an elevator system, said elevator system including at least one multi-deck elevator, and a destination call device with which a passenger gives his/her destination floor at the beginning of the journey route, thereby defining the starting point and final point of the passenger's journey route in the elevator system, causes said elevator system to perform a method for allocating destination calls, the method comprising:

generating possible route alternatives from the starting point to the final point of the passenger's journey route;

determining a cost function for the route alternatives, said cost function containing at least one travel time term;

determining the value of the at least one travel time term corresponding to each route alternative in the cost function;

calculating the total cost of each route alternative by using the cost function;

allocating, for the passenger, the route alternative having the lowest calculated total cost;

guiding the passenger to a waiting lobby and/or elevator according to the route alternative allocated; and generating a transfer route model in which one or more travel time forecasts for one or more transfer routes in the elevator system are determined on the basis of a criterion dependent on a state of the elevator system.

* * * * *